US010270174B2

(12) United States Patent
Paulotto et al.

(10) Patent No.: US 10,270,174 B2
(45) Date of Patent: Apr. 23, 2019

(54) MILLIMETER WAVE ANTENNAS HAVING CROSS-SHAPED RESONATING ELEMENTS

(71) Applicant: Apple Inc., Cupertino, CA (US)

(72) Inventors: Simone Paulotto, Redwood City, CA (US); Basim H. Noori, San Jose, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/659,503

(22) Filed: Jul. 25, 2017

(65) Prior Publication Data

US 2019/0036220 A1 Jan. 31, 2019

(51) Int. Cl.
*H01Q 1/38* (2006.01)
*H01Q 9/04* (2006.01)

(52) U.S. Cl.
CPC ..... *H01Q 9/0407* (2013.01); *H01Q 1/38* (2013.01)

(58) Field of Classification Search
CPC ..... H01Q 9/0407; H01Q 1/38
See application file for complete search history.

(56) References Cited

U.S. PATENT DOCUMENTS 5,448,250 A 9/1995 Day
6,239,762 B1 5/2001 Lier
8,354,972 B2 1/2013 Borja et al.
9,583,837 B2 2/2017 Xue et al.
9,590,313 B2 3/2017 Jan et al.
2015/0194730 A1 7/2015 Sudo et al.
2017/0110787 A1 4/2017 Ouyang et al.
2017/0117754 A1 4/2017 Noori et al.
2018/0159203 A1* 6/2018 Baks ..... H01Q 1/2283

OTHER PUBLICATIONS

Paulotto et al., U.S. Appl. No. 15/650,638, filed Jul. 14, 2017.
Paulotto et al., U.S. Appl. No. 15/650,627, filed Jul. 14, 2017.
Paulotto et al., U.S. Appl. No. 15/650,689, filed Jul. 14, 2017.
Noori et al., U.S. Appl. No. 15/138,684, filed Apr. 26, 2016.
Mow et al., U.S. Appl. No. 15/217,805, filed Jul. 22, 2016.

* cited by examiner

*Primary Examiner* — Dameon E Levi
*Assistant Examiner* — David E Lotter
(74) *Attorney, Agent, or Firm* — Treyz Law Group, P.C.; Michael H. Lyons

(57) ABSTRACT

An electronic device may be provided with an antenna and transceiver circuitry such as millimeter wave transceiver circuitry. The antenna may include an antenna ground and a resonating element. The resonating element may include a cross-shaped patch having arms extending along different longitudinal axes, conductive landing pads interposed between the cross-shaped patch and the antenna ground, and vertical conductive legs extending between each of the arms and corresponding landing pads. The antenna may be fed using a first antenna feed coupled between a first of the landing pads and the antenna ground and a second antenna feed coupled between a second of the landing pads and the antenna ground. The landing pads, antenna ground, and cross-shaped patch may be formed from conductive traces on different layers of a dielectric substrate.

19 Claims, 8 Drawing Sheets

MILLIMETER WAVE ANTENNAS HAVING CROSS-SHAPED RESONATING ELEMENTS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths but may raise significant challenges. For example, millimeter wave communications are often line-of-sight communications and can be characterized by substantial attenuation during signal propagation.

It would therefore be desirable to be able to provide electronic devices with improved wireless communications circuitry such as communications circuitry that supports communications at frequencies greater than 10 GHz.

SUMMARY

An electronic device may be provided with wireless circuitry. The wireless circuitry may include an antenna and transceiver circuitry such as millimeter wave transceiver circuitry.

The antenna may include an antenna ground and an antenna resonating element. The transceiver circuitry may transmit and receive antenna signals between 10 GHz and 300 GHz using the antenna. The antenna resonating element may include a cross-shaped patch having first and second arms extending along a first longitudinal axis and third and fourth arms extending along a second longitudinal axis perpendicular to the first longitudinal axis. The antenna resonating element may include conductive landing pads interposed between the cross-shaped patch and the antenna ground. The antenna resonating element may include vertical conductive legs extending between each of the arms of the cross-shaped patch and respective conductive landing pads.

The antenna may be fed using a first antenna feed coupled between a first of the landing pads and the ground plane and a second antenna feed coupled between a second of the landing pads and the ground plane. The cross-shaped patch, antenna ground, and landing pads may be formed from conductive traces on different layers of a stacked dielectric substrate. The vertical conductive legs may be formed using conductive vias extending through the layers of the substrate. Switching circuitry may be interposed between the first and second antenna feeds and the transceiver circuitry. Control circuitry may adjust the switching circuitry between a high efficiency mode in which only one of the antenna feeds is active and a polarization diversity mode in which both antenna feeds are active (e.g., based on the current operating requirements of the device).

DETAILED DESCRIPTION

Figure 1:
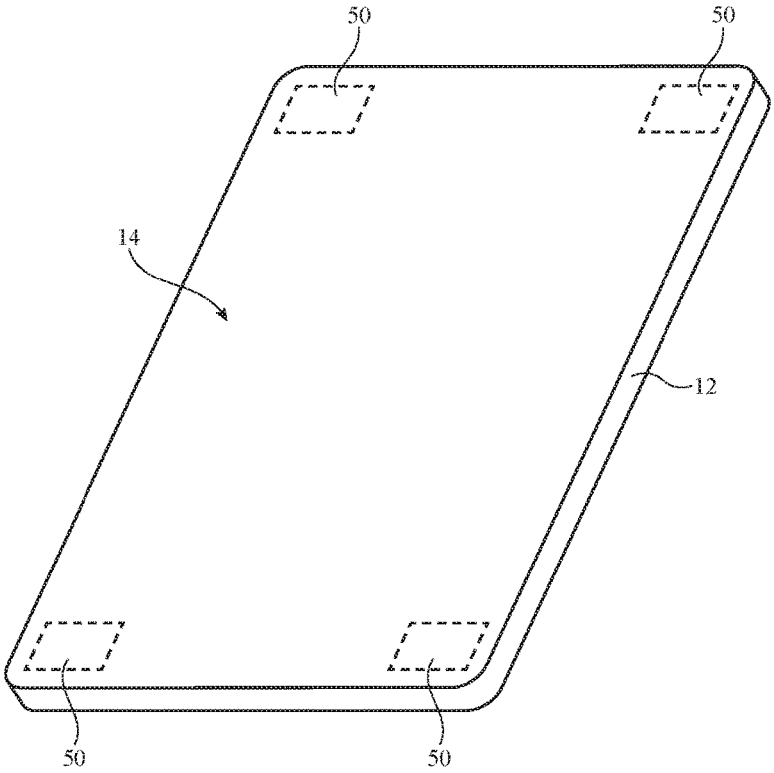
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Display 14 may contain an active area with an array of pixels (e.g., a central rectangular portion). Inactive areas of display 14 are free of pixels and may form borders for the active area. If desired, antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
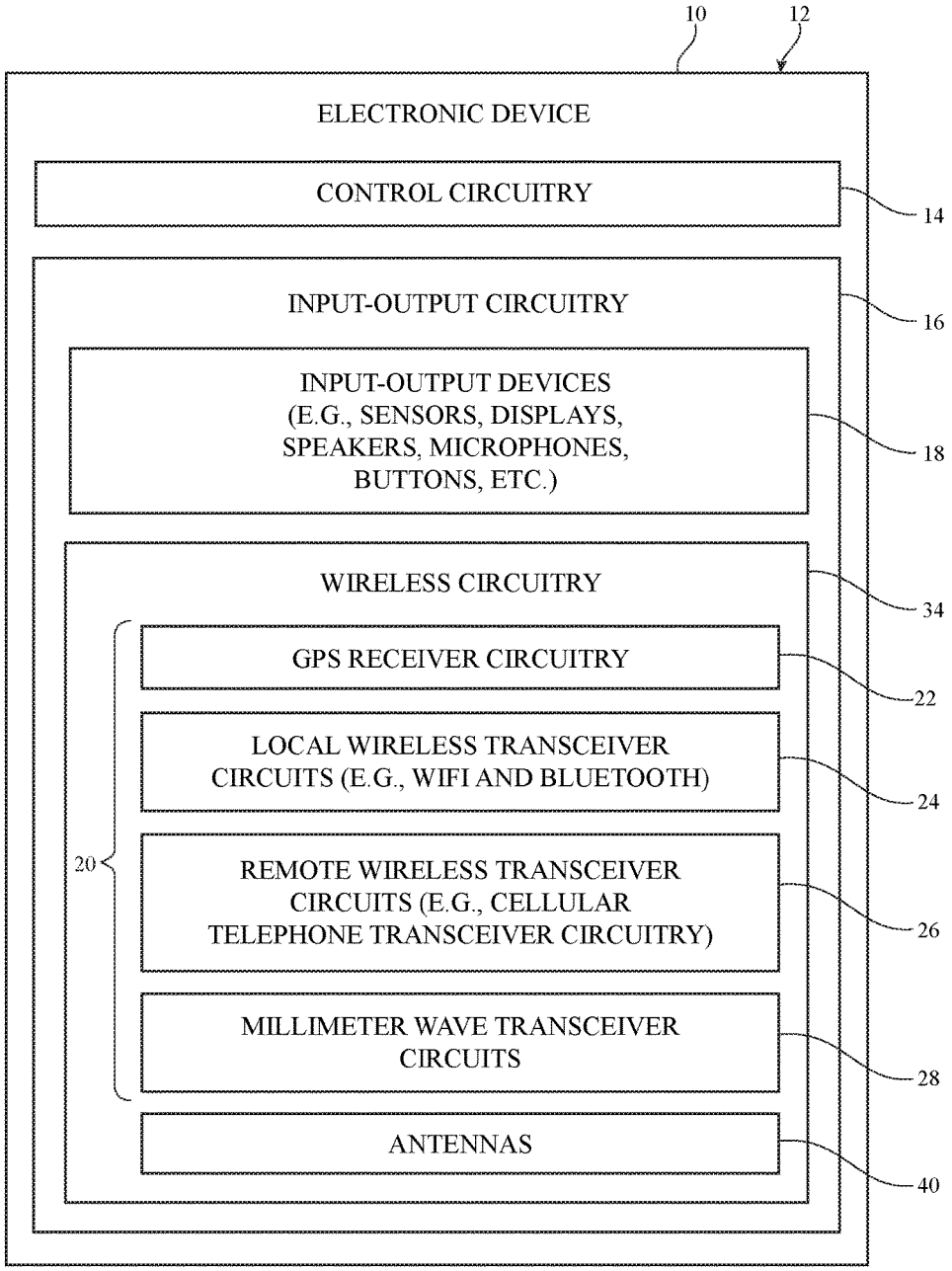
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, $5^{th}$ generation mobile networks or $5^{th}$ generation wireless systems (5G) protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network (WLAN) transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications from 2300 to 2700 MHz or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over these short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from patch structures (e.g., cross-shaped patch structures coupled to vertical legs that are terminated in planar conductive pads below the cross-shaped patch structures), loop antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can one or more antennas such as antennas arranged in one or more phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial probes realized by metal vias, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, impedance matching circuitry, and other circuitry may be interposed within the transmission lines, if desired.

In devices such as handheld devices, the presence of an external object such as the hand of a user or a table or other surface on which a device is resting has a potential to block wireless signals such as millimeter wave signals. Accordingly, it may be desirable to incorporate multiple antennas or phased antenna arrays into device 10, each of which is placed in a different location within device 10. With this type of arrangement, an unblocked antenna or phased antenna array may be switched into use. In scenarios where a phased antenna array is formed in device 10, once switched into use, the phased antenna array may use beam steering to optimize wireless performance. Configurations in which antennas from one or more different locations in device 10 are operated together may also be used.

Figure 3:
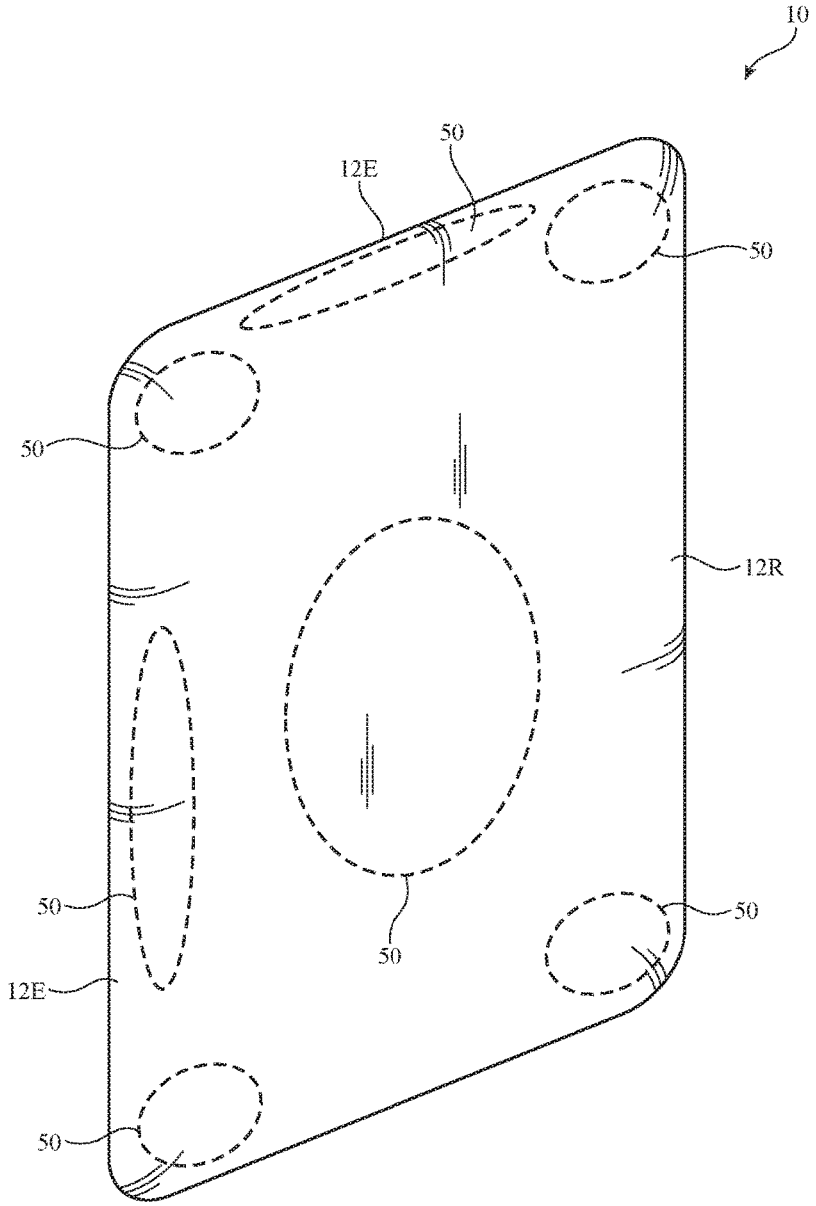
FIG. 3 is a rear perspective view of an illustrative electronic device showing illustrative locations at which antennas for communications at frequencies greater than 10 GHz may be located in accordance with an embodiment.

FIG. 3 is a perspective view of electronic device 10 showing illustrative locations 50 on the rear of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. Each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
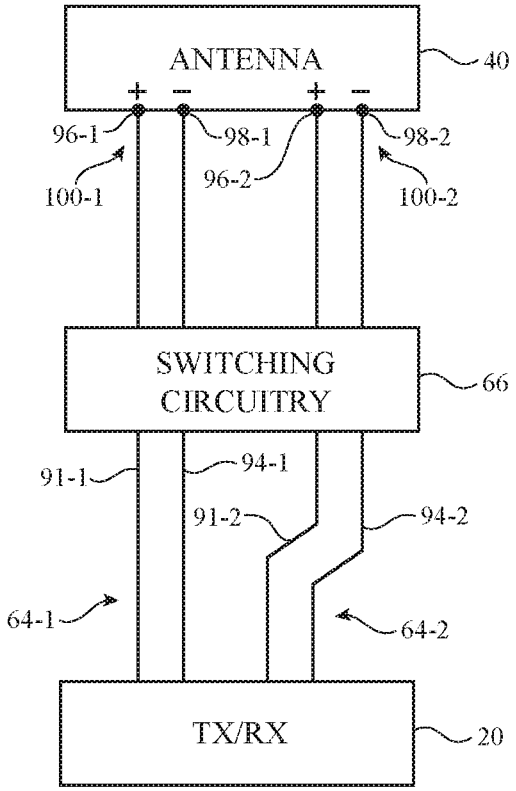
FIG. 4 is a diagram of illustrative transceiver circuitry and antenna in accordance with an embodiment.

A schematic diagram of an antenna 40 coupled to transceiver circuitry 20 (e.g., transceiver circuitry 28) is shown in FIG. 4. As shown in FIG. 4, radio-frequency transceiver circuitry 20 may be coupled to antenna feeds 100 of antenna 40 using corresponding transmission lines 64. If desired, antenna 40 may include multiple antenna feeds 100. In the example of FIG. 4, antenna 40 includes a first antenna feed 100-1 coupled to transceiver circuitry 20 over a first transmission line 64-1 and a second antenna feed 100-2 coupled to transceiver circuitry 20 over a second transmission line 64-2. This is merely illustrative and, if desired, antenna 40 may only have a single feed 100 (e.g., one of feeds 100-1 or 100-2) or may have more than three feeds. The use of multiple feeds may, for example, allow antenna 40 to cover a greater number of polarizations than in scenarios where only a single feed is used (e.g., multiple linear polarizations such as horizontal and vertical polarizations, a circular polarization, an elliptical polarization, etc.).

Antenna feeds 100 may each include a corresponding positive antenna feed terminal 96 and a corresponding ground antenna feed terminal 98. As shown in FIG. 4, antenna feed 100-1 includes positive feed terminal 96-1 and ground feed terminal 98-1 whereas antenna feed 100-2 includes positive feed terminal 96-2 and a ground feed terminal 98-2.

Transmission lines 64 may be formed form metal traces on a printed circuit or other conductive structures and may have a positive transmission line signal path such as path 91 that is coupled to terminal 96 and a ground transmission line signal path such as path 94 that is coupled to terminal 98. In the example of FIG. 4, transmission line 64-1 includes positive signal path 91-1 coupled to feed terminal 96-1 and ground signal path 94-1 coupled to feed terminal 98-1 whereas transmission line 64-2 includes positive signal path 91-2 coupled to feed terminal 96-2 and ground signal path 94-2 coupled to feed terminal 98-2.

Transmission line paths such as paths 64-1 and 64-2 may be used to route antenna signals (e.g., antenna signals at frequencies between 10 GHz and 300 GHz such as millimeter wave signals) within device 10. Transmission lines 64-1 and 64-2 may each include coaxial probes realized by metal vias, microstrip transmission lines, stripline transmission lines, edge-coupled microstrip transmission lines, coaxial cables, edge-coupled stripline transmission lines, waveguide structures, transmission lines formed from combinations of transmission lines of these types, etc. Filter circuitry, switching circuitry, impedance matching circuitry, amplifier circuitry, phase shifter circuitry, and other circuitry may be interposed within transmission line 64-1 and/or transmission line 64-2 and/or circuits such as these may be incorporated into antenna 40 if desired (e.g., to support antenna tuning, to support operation in desired frequency bands, etc.).

In the example of FIG. 4, switching circuitry 66 may be interposed on transmission lines 64-1 and 64-2. Switching circuitry 66 may be controlled using control signals provided by control circuitry 14 (FIG. 2) to selectively activate zero, one, or both of feeds 100-1 and 100-2 for antenna 40. For example, switching circuitry 66 may have a first state at which feed 100-1 is active (e.g., enabled or coupled to transceiver 20) and feed 100-2 is inactive (e.g., disabled or decoupled from transceiver 20), a second state at which feed 100-1 is inactive and feed 100-2 is active, a third state at which feeds 100-1 and 100-2 are both active, and a fourth state at which both feeds 100-1 and 100-2 are inactive.

Using a single feed at a given time may involve an enhanced overall antenna efficiency for antenna 40 relative to scenarios where both feeds are used (e.g., due to potential coupling between active feeds 100-1 and 100-2). However, using both feeds 100-1 and 100-2 at a given time may allow antenna 40 to cover a greater number of polarizations such as orthogonal horizontal and vertical polarizations, circular polarizations, elliptical polarizations, etc. If desired, control circuitry 14 may activate one of feeds 100-1 and 100-2 in scenarios where relatively high antenna efficiency is needed (e.g., when device 10 is in a region of low wireless signal strength with a base station or access point) and may activate both feeds 100-1 and 100-2 when it is desired to cover multiple polarizations (e.g., a circular polarization, orthogonal linear polarizations, etc.).

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may be arranged in one or more antenna arrays (e.g., phased antenna arrays to implement beam steering functions). For example, the antennas that are used in handling millimeter and centimeter wave signals for wireless transceiver circuits 28 may be implemented as phased antenna arrays. The radiating elements in a phased antenna array for supporting millimeter and centimeter wave communications may be patch antennas (e.g., cross-shaped patch antennas having a planar cross-shaped conductor and vertical legs that extend from the planar cross-shaped conductor and are terminated in planar conductive pads below the planar cross-shaped conductor), dipole antennas, dipole antennas with directors and reflectors in addition to dipole antenna resonating elements (sometimes referred to as Yagi antennas or beam antennas), or other suitable antenna elements. Transceiver circuitry can be integrated with the phased antenna arrays to form integrated phased antenna array and transceiver circuit modules if desired.

Figure 5:
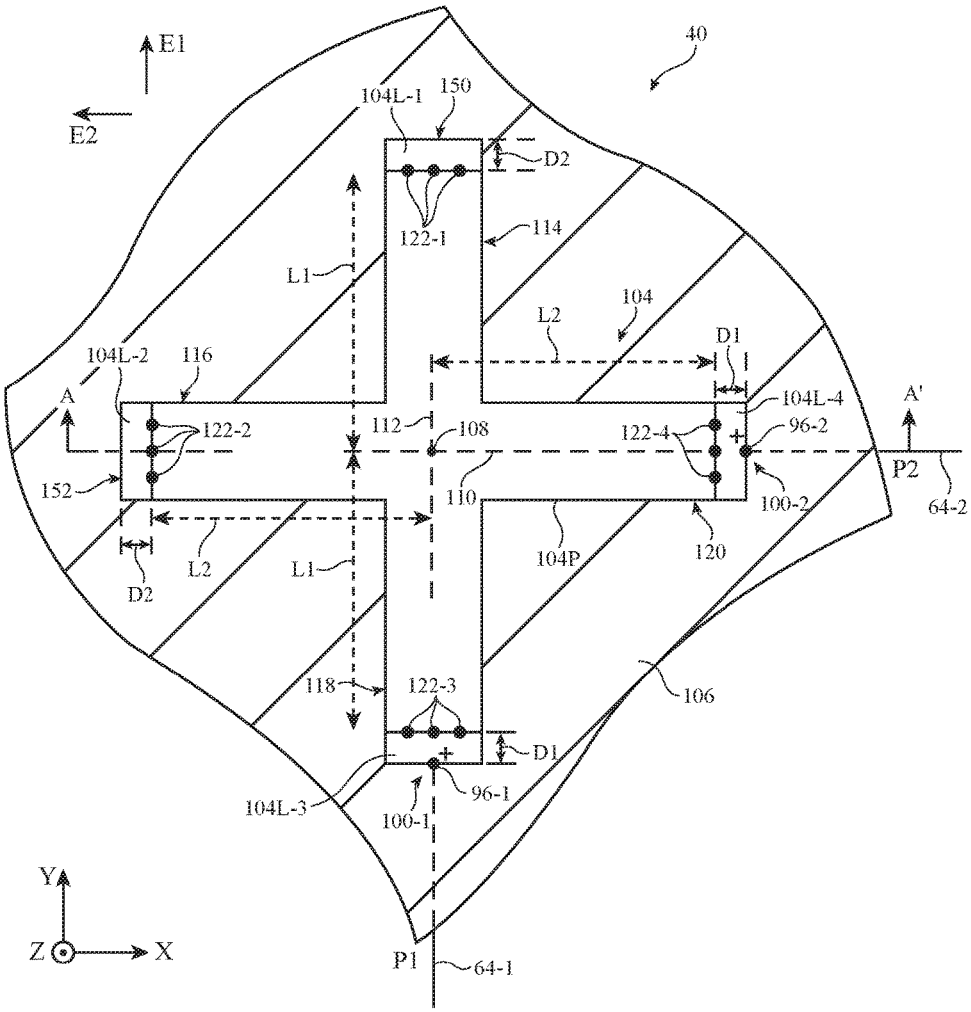
FIG. 5 is a top-down view of an illustrative antenna having a cross-shaped resonating element in accordance with an embodiment.

FIG. 5 is a top-down view of an illustrative patch antenna 40 (e.g., a patch antenna having a planar cross-shaped conductor and vertical legs that extend from the planar cross-shaped conductor and are terminated in planar conductive pads below the planar cross-shaped conductor). As shown in FIG. 5, antenna 40 may include an antenna resonating element 104 (e.g., a patch antenna resonating element) that is separated from a ground plane such as antenna ground plane 106 (e.g., in the direction of the Z-axis of FIG. 5).

Antenna resonating element 104 may include a planar cross-shaped conductor 104P (sometimes referred to herein as patch 104P or resonating element portion 104P) and multiple planar conductive pads 104L (e.g., a first pad 104L-1, a second pad 104L-2, a third pad 104L-3, and a fourth pad 104L-4) formed below conductor 104P. Conductor 104P and pads 104L (sometimes referred to herein as landing pads 104L or contact pads 104L) may both be separated from and may have lateral surface areas parallel to antenna ground plane 106. Pads 104L may each be located at a first distance above ground plane 106 whereas conductor 104P is located at a second, greater, distance above ground plane 106 (e.g., pads 104L may be interposed between conductor 104P and ground plane 106).

Each conductive pad 104L may be shorted to conductor 104P over corresponding vertical conductive structures 122 (e.g., pad 104L-1 may be coupled to conductor 104P over vertical conductive structures 122-1, pad 104L-2 may be coupled to conductor 104P over vertical conductive structures 122-2, pad 104L-3 may be coupled to conductor 104P over vertical conductive structures 122-3, and pad 104L-4 may be coupled to conductor 104P over vertical conductive structures 122-4). Pads 104L and conductor 104P may each have lateral surface areas parallel to the X-Y plane of FIG. 5 whereas vertical conductive structures 122 between conductor 104P and pads 104L (e.g., parallel to the Z-axis of FIG. 5). Vertical conductive structures 122 may sometimes be referred to herein as legs 122.

To enhance the polarizations handled by patch antenna 40, antenna 40 may be provided with multiple feeds such as feeds 100-1 and 100-2 (FIG. 4). As shown in FIG. 5, antenna 40 may have a first feed 100-1 at antenna port P1 that is coupled to transmission line 64-1 and a second feed 100-2 at antenna port P2 that is coupled to transmission line 64-2. First antenna feed 100-1 may have a first ground feed terminal 98-1 (not shown in FIG. 5 for the sake of clarity) coupled to ground 106 and a first positive feed terminal 96-1 coupled to conductive pad 104L-3. Second antenna feed 100-2 may have a second ground feed terminal coupled to ground 106 and a second positive feed terminal 96-2 coupled to conductive pad 104L-4.

In the example of FIG. 5, conductor 104P of resonating element 104 has a cross or "X" shape. In order to form the cross shape, conductor 104P may include multiple conductive arms extending from different sides of a central point 108 along at least two longitudinal axes oriented at non-parallel angles with respect to each other. As shown in FIG. 5, cross-shaped conductor 104P may include a first arm 114, a second arm 116, a third arm 118, and a fourth arm 120 that extend from different sides of the center point 108 of element 104P. First arm 114 may oppose third arm 118 whereas second arm 116 opposes fourth arm 120 (e.g., arms 114 and 118 may extend in parallel and from opposing sides of center point 108 of element 104P and arms 116 and 120 may extend in parallel and from opposing sides of center point 108).

Arms 114 and 118 may extend along a first longitudinal axis 112 whereas arms 116 and 120 extend along a second longitudinal axis 110. Longitudinal axis 112 may be oriented at a non-parallel angle with respect to longitudinal axis 110 (e.g., an angle between 0 degrees and 180 degrees) such as approximately 90 degrees. Antenna resonating element 104 may include a respective set of vertical legs 122 and a corresponding conductive pad 104L for each leg of patch 104P.

Arms 114 and 118 may each have a length L1. Arms 116 and 120 may each have a length L2. Feed terminal 96-2 on pad 104L-4 may be separated from vertical conductive structures 122-4 by lateral distance D1 (e.g., in the X-Y plane of FIG. 5). Vertical conductive structures 122-2 may be separated from end 152 of pad 104L-2 by distance D2. Similarly, feed terminal 96-1 on pad 104L-3 may be separated from vertical conductive structures 122-3 by distance D1 and vertical conductive structures 122-1 may be separated from end 150 of pad 104L-1 by distance D2. Lengths L1, L2, D1, D2, and the height of vertical conductive structures 122 (e.g., in the direction of the Z-axis of FIG. 5) may be selected so that antenna 40 resonates at desired frequencies (e.g., frequencies between 10 GHz and 300 GHz).

For example, when first antenna feed 100-1 associated with port P1 is active, antenna 40 may transmit and/or receive antenna signals in a first communications band at a first frequency (e.g., a frequency at which one-half of the corresponding wavelength is approximately equal to two times dimension L1, plus two times the height of vertical conductors 122, plus length D1 and length D2). These signals may have a first polarization (e.g., the electric field E1 of the antenna signals associated with port P1 may be oriented parallel to dimension Y).

When using the antenna feed associated with port P2, antenna 40 may transmit and/or receive antenna signals in a second communications band at a second frequency (e.g., a frequency at which one-half of the corresponding wavelength is approximately equal to (e.g., within 15% of) two times dimension L2, plus two times the height of vertical conductors 122, plus length D1 and length D2). These signals may have a second polarization (e.g., the electric field E2 of the antenna signals associated with port P2 may be oriented parallel to dimension X so that the polarizations associated with ports P1 and P2 are orthogonal to each other).

Distributing the resonating length of resonating element 104 across both horizontal and vertical dimensions in this way may reduce the overall footprint of antenna 40 (e.g., the lateral size of antenna 40 in the X-Y plane) relative to scenarios where antenna 40 includes a patch antenna resonating element located entirely within a single plane, thereby optimizing the use of space within device 10, as an example. The width of arms 114, 116, 118, and 120, and/or the width of pads 104L (e.g., as measured perpendicular to axis 110 for arms 116 and 120 and pads 104L-2 and 104L-4 or perpendicular to axis 112 for arms 114 and 118 and pads 104L-1 and 104L-3) may be adjusted to ensure that resonating element is impedance matched with transmission lines 64-1 and 64-2, for example.

In the example of FIG. 5, length L1 is equal to length L2 (e.g., cross-shaped conductor 104P extends across a square outline). In this scenario, ports P1 and P2 may cover the same communications band (frequencies) with greater polarization diversity than in scenarios where only one port is used (e.g., using two orthogonal linear polarizations). In scenarios where patch 104P extends across a non-square rectangular outline (e.g., where length L1 is different from L2), ports P1 and P2 may cover different communications bands or frequencies if desired. During wireless communications using device 10, device 10 may use port P1, port P2, or both port P1 and P2 to transmit and/or receive signals (e.g., millimeter wave signals) at one or more frequencies using a single linear polarization, two orthogonal linear polarizations, or circular or elliptical polarizations (e.g., by adjusting phase shifting circuitry coupled between transceiver circuitry 20 and feed terminals 96-1 and 96-2).

If desired, resonating element 104 and/or ground 106 may be formed on a dielectric substrate (not shown in FIG. 5 for the sake of clarity). In scenarios where resonating element 104 is not formed on a dielectric substrate or the dielectric substrate is confined to the volume between vertical conductors 122-1, 122-2, 122-3, and 122-4 and under pads 104L, conductor 104P, vertical conductive structures 122, and/or pads 104L may be formed from metal foil, stamped sheet metal, electronic device housing structures, or any other desired conductive structures (e.g., resonating element 104 may be formed from a single continuous piece of metal where arms 114, 116, 118, and 120 have ends that are bent or folded downwards to form vertical conductive structures 122 and where the ends of vertical conductive structures 122 are bent upwards to form pads 104L). Vertical conductive structures 122 may include conductive pins, conductive springs, conductive adhesive, solder, welds, or any other desired vertical conductive structures.

In scenarios where resonating element 104 and ground 106 are formed on a dielectric substrate (e.g., a rigid or flexible printed circuit board, dielectric block, etc.), conductor 104P and pads 104L may be formed from conductive (e.g., metal) traces on the dielectric substrate or dielectric layers within the substrate. In this scenario, vertical conductive structures 122 may include vertical conductive vias extending through the dielectric substrate.

The example of FIG. 5 is merely illustrative. Each arm of conductor 104P may be coupled to the corresponding conductive pad 104L through one vertical conductive structure 122, two conductive structures 122, three conductive structures 122 (as shown in the example of FIG. 5), or more than three conductive structures 122. Conductive pads 104L may have any desired shape (e.g., shapes having curved and/or straight edges) and may have widths that are greater than, equal to, or less than the width of the arms of conductor 104P. Conductor 104P may have curved and/or straight edges or may have other shapes or orientations if desired.

Figure 6:
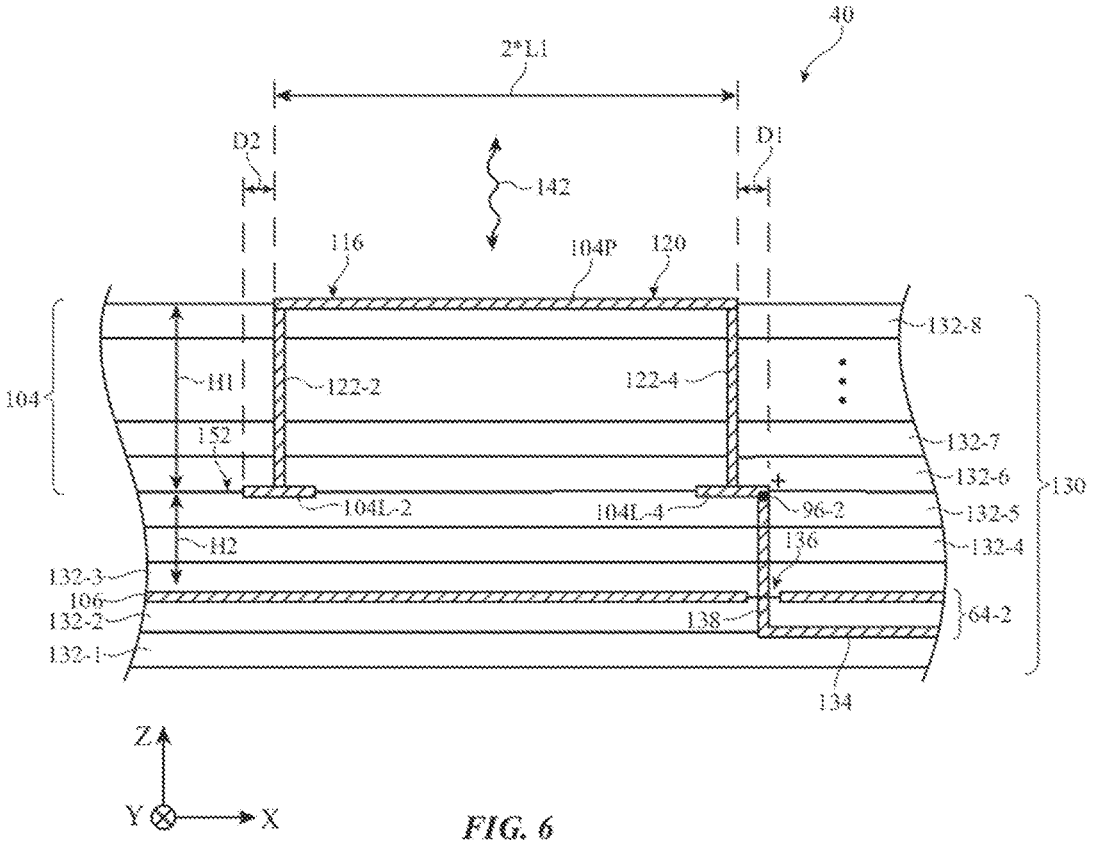
FIG. 6 is a cross-sectional side view of an illustrative antenna having a cross-shaped resonating element in accordance with an embodiment.

FIG. 6 is a cross-sectional side view of antenna 40 for covering communications bands between 10 GHz and 300 GHz (e.g., as taken along line AA' of FIG. 5). As shown in FIG. 6, antenna 40 may be formed on a dielectric substrate such as substrate 130. Substrate 130 may be, for example, a rigid or printed circuit board or other dielectric substrate. Substrate 130 may include multiple dielectric layers 132 (e.g., multiple layers of printed circuit board substrate such as multiple layers of fiberglass-filled epoxy) such as a first dielectric layer 132-1, a second dielectric layer 132-2 over the first dielectric layer, a third dielectric layer 132-3 over the second dielectric layer, a fourth dielectric layer 132-4 over the third dielectric layer, a fifth dielectric layer 132-5 over the fourth dielectric layer, a sixth dielectric layer 132-6 over the fifth dielectric layer, a seventh dielectric layer 132-7 over the sixth dielectric layer, and an eighth dielectric layer 132-8 over the seventh dielectric layer. Additional or fewer dielectric layers 132 may be stacked within substrate 130 if desired.

With this type of arrangement, antenna 40 may be embedded within the layers of substrate 130. For example, ground plane 106 may be formed on a surface of second layer 132-2, conductive landing pads 104L (e.g., second pad 104L-2 and fourth pad 104L-4 as shown in FIG. 6) may be formed on a surface of layer 132-5, and cross-shaped conductor 104P may be formed on a surface of layer 132-8. In this way, conductive pads 104L may have a lateral surface area in the X-Y plane of FIG. 6 and may be located at a distance H2 with respect to ground plane 106. Conductor 104P may have a lateral surface area in the X-Y plane and may be separated from pads 104L by distance H1 (e.g., a distance of H1+H2 with respect to ground 106). Distance H1 may be the same as distance H2, less than distance H2, or greater than distance H2. Distances H1 and H2 may be between 0.1 mm and 10 mm, as examples. In general, adjusting distances H1 and H2 may serve to adjust the bandwidth of antenna 40.

Antenna 40 may be fed using a transmission line such as transmission line 64-2 (transmission line 64-1 of FIG. 5 is not shown in the cross-sectional side view of FIG. 6). Transmission line 64-2 may, for example, be formed from a conductive trace such as conductive trace 134 on layer 132-1 and portions of ground layer 106. Conductive trace 134 may form the positive signal conductor for transmission line 64-2, for example. A hole 136 may be formed in ground layer 106. Transmission line 64-2 may include a vertical conductor 138 (e.g., a conductive through-via, metal pillar, metal wire, conductive pin, or other vertical conductive interconnect structures) that extends from trace 134 through layer 132-2, hole 136 in ground layer 106, and layers 132-3, 132-4, and 132-5 to antenna feed terminal 96-2 on conductive landing pad 104L-4. This example is merely illustrative and, if desired, other transmission line structures may be used (e.g., coaxial cable structures, stripline transmission line structures, etc.).

Transmission line 64-2 may convey antenna signals for antenna 40 (e.g., to and from transceiver 20) such as antenna signals at frequencies between 10 GHz and 300 GHz (e.g., millimeter wave antenna signals). Corresponding antenna currents may flow over terminal 96-2 to vertical conductor 122-4 over distance D1, through vertical conductor 122-4 to vertical conductor 122-2 over arms 120 and 116 of cross-shaped conductive patch 104P (e.g., across a distance of 2*L1), through vertical conductor 122-2 to pad 104L-2, and over distance D2 to end 152 of pad 104L-2. This path length (e.g., D1+H1+2*L1+H1+D2) may be approximately equal to (e.g., within 15% of) one-half of the wavelength of operation (e.g., a wavelength corresponding to a frequency between 10 GHz and 300 GHz such as a centimeter or millimeter scale wavelength). This path length may, for example, be reduced by a constant factor based on the dielectric constant of the materials used to form dielectric substrate 130. The antenna currents flowing through resonating element 104 may produce (or be generated by) wireless antenna signals 142 (e.g., wireless signals at frequencies between 10 GHz and 300 GHz such as wireless millimeter wave signals).

The example of FIG. 6 is merely illustrative. While the example of FIG. 6 shows structures associated with port P2 and arms 116 and 120 of patch 104P of FIG. 5, conductive pads 104L-1 and 104L-3 may also be formed on dielectric layer 132-5 of substrate 130 and arms 114 and 118 may also be formed on layer 132-8 of FIG. 6. Transmission line 64-1 for feed 100-1 may include traces formed on layer 132-1 that are coupled to landing pad 104L-3 via a corresponding vertical conductor. If desired, additional layers 132 may be interposed between traces 134 and 106, and additional or fewer layers 132 may be interposed between traces 106 and traces 104L and/or between traces 104L and traces 104P. In another suitable arrangement, substrate 130 may be formed from a single dielectric layer (e.g., antennas 40 may be embedded within a single dielectric layer such as a molded plastic layer). In yet another suitable arrangement, substrate 130 may be omitted and antenna 40 may be formed on other substrate structures or may be formed without substrates.

Figure 7:
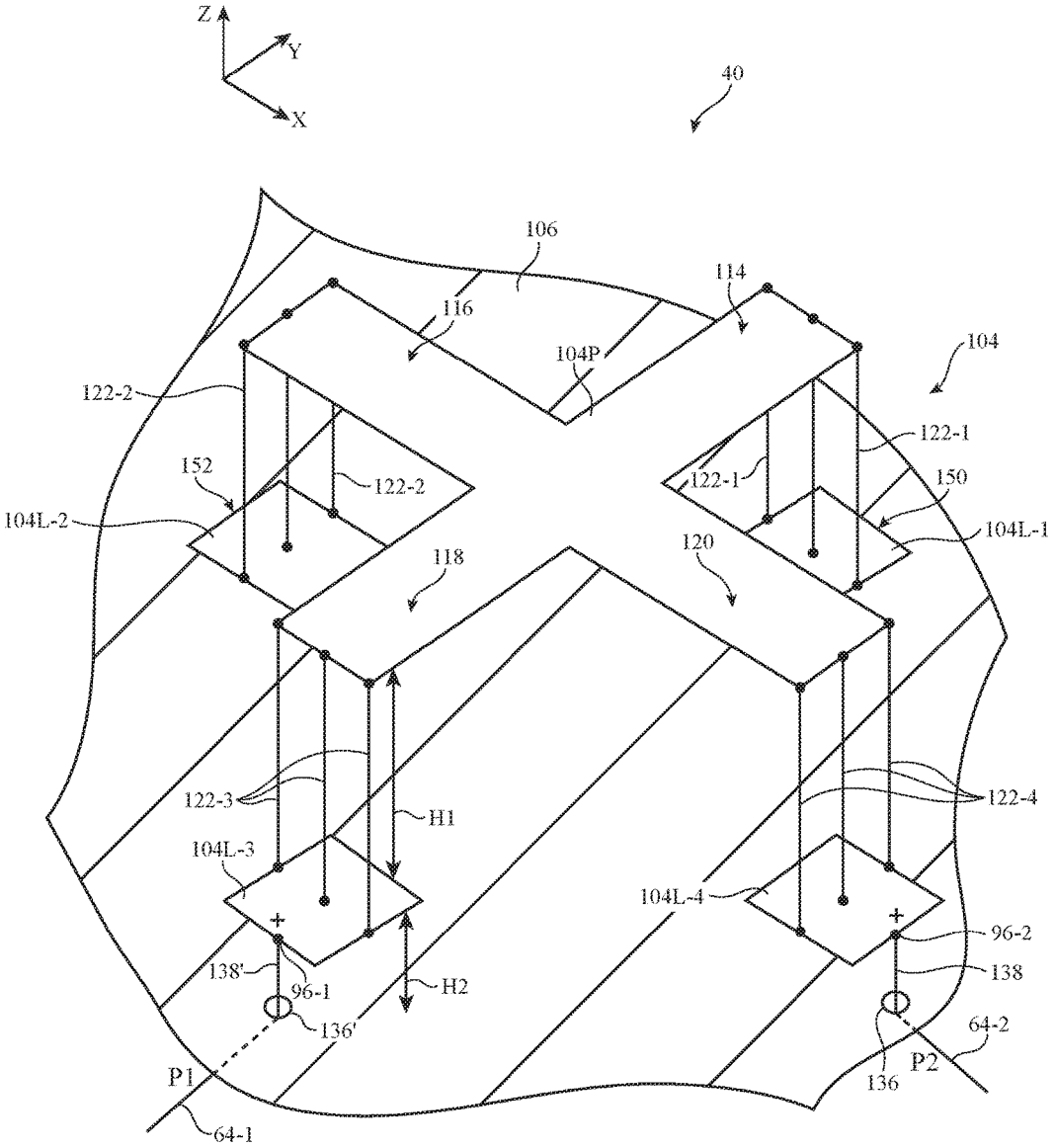
FIG. 7 is a perspective view of an illustrative antenna having a cross-shaped resonating element in accordance with an embodiment.

FIG. 7 is a perspective view of antenna 40 for handling antenna signals between 10 GHz and 300 GHz. In the example of FIG. 7, dielectric 130 is not shown for the sake of clarity. As shown in FIG. 7, conductive pads 104L are formed at distance H2 above ground plane 106. Cross-shaped patch conductor 104P is formed at distance H1 above conductive pads 104L. Arm 116 of patch 104P is coupled to pad 104L-2 via a set of vertical conductors 122-2, arm 114 of patch 104P is coupled to pad 104L-1 via a set of vertical conductors 122-1, arm 120 of patch 104P is coupled to pad 104L-4 via a set of vertical conductors 122-4, and arm 118 of patch 104P is coupled to pad 104L-3 via a set of vertical conductors 122-3.

A first hole 136 and a second hole 136' may be formed in ground plane 106. Transmission line 64-2 (e.g., the corresponding vertical conductor 138 as shown in FIG. 6) may extend through hole 136 to feed terminal 96-2 on landing pad 104L-4 of resonating element 104. Transmission line 64-1 may include a vertical conductor 138' that extends through hole 136' in ground plane 106 to feed terminal 96-1 on landing pad 104-3. Antenna signals (e.g., antenna currents) may be conveyed over feed terminal 96-1, over pad 104L-3 to vertical conductors 122-3, through vertical conductors 122-3, over arms 118 and 114 of patch 104P, through vertical conductors 122-1, and over pad 104L-1.

When both feeds 100-1 and 100-2 are active (e.g., when control circuitry 14 of FIG. 2 couples both feeds to transceiver 28 using switching circuitry 66 of FIG. 4), antenna 40 may convey wireless signals with greater polarization diversity than when a single feed is used. For example, antenna signals having orthogonal linear polarizations may be concurrently conveyed over both feed 100-1 (and conductors 104L-3, 122-3, 118, 114, 122-1, and 104L-1) and feed 100-2 (and conductors 122-4, 120, 116, 122-2, and 104L-2).

Because arms 116, 114, 118, and 120 are all formed from the same continuous piece of conductive material (i.e., patch 104P), some electromagnetic coupling between feeds 100-1 and 100-2 may be present when both ports P1 and P2 are active. This may reduce the overall antenna efficiency of antenna 40 when both feeds (ports) are active. If desired, control circuitry 14 may control switching circuitry 66 (FIG. 4) to use only a single feed at a given time to eliminate this electromagnetic coupling. This may serve to increase the overall antenna efficiency of antenna 40 while also reducing the polarization diversity of antenna 40. Control circuitry 14 may change the number of active feeds based on the current operating conditions of device 10 if desired (e.g., based on sensor data, signal quality information, information on what operations are being performed by device 10, etc.). Antenna 40 may provide coverage for wireless communications circuitry 34 at frequencies between 10 GHz and 300 GHz (e.g., frequencies between 27 GHz and 41 GHz, frequencies between 30 GHz and 300 GHz, etc.) with dynamically adjustable polarization diversity and while occupying less space within device 10 relative to scenarios where the antenna resonating element is formed from a single patch located in a single plane. In addition, when configured in this way, antenna 40 may exhibit a relatively uniform radiation pattern.

Figure 8:
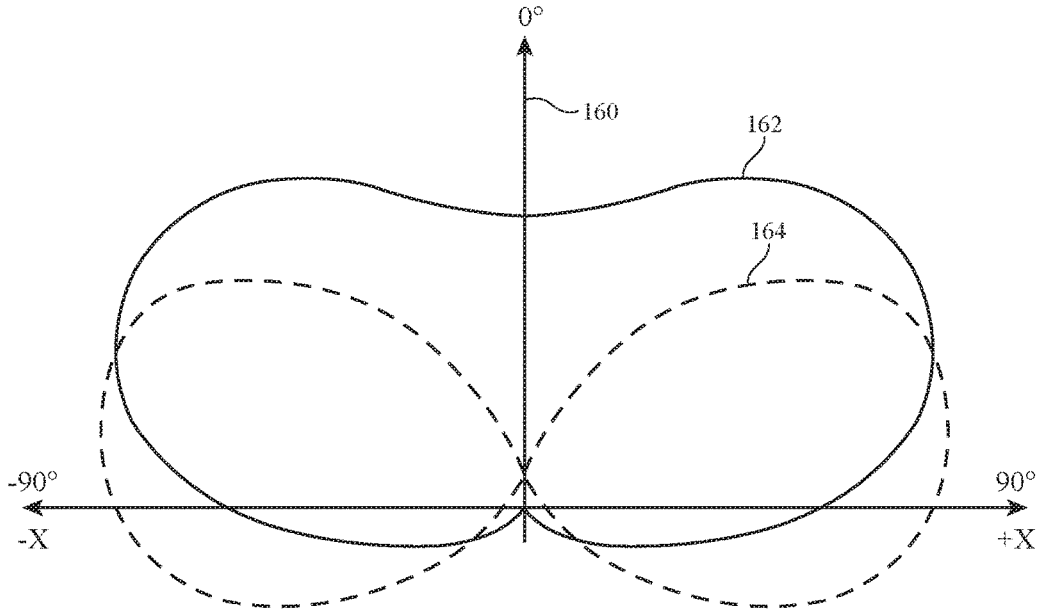
FIG. 8 is a diagram showing a radiation pattern of an illustrative antenna of the type shown in FIGS. 2-7 in accordance with an embodiment.

FIG. 8 is a cross-sectional diagram of an exemplary radiation pattern that may be exhibited by antenna 40 (e.g., where the surface of patch 104P lies in the X-Y plane of FIG. 8). Curve 164 may represent the radiation pattern of a conventional dipole antenna. As shown in FIG. 8, curve 164 exhibits relatively strong coverage (e.g., relatively high gain) at angles between about +45 degrees and +90 degrees and between about −45 degrees and −90 degrees. However, curve 164 exhibits a node (minimum) around 0 degrees. As such, an antenna corresponding to pattern 164 may provide insufficient coverage (e.g., may exhibit relatively low gain) when communicating with external communications equipment located around 0 degrees with respect to the antenna.

Curve 162 may represent the radiation pattern of antenna 40 of FIGS. 2-7. As shown in FIG. 8, radiation pattern 162 exhibits relatively strong coverage at angles between −90 degrees and 0 degrees and at angles between +90 degrees and 0 degrees, as well as at angles around 0 degrees. As such antenna 40 may provide improved coverage around 0 degrees relative to conventional dipole antennas, thereby allowing device 10 to communicate with external communications equipment located around 0 degrees with respect to antenna 40 (e.g., with satisfactory link quality).

The example of FIG. 8 is merely illustrative and, if desired, curve 162 may have other shapes. As shown in FIG. 8, curve 162 illustrates the cross-sectional radiation pattern of antenna 40. However, in general, curve 162 may be rotated around the axis 160 to give a full three-dimensional pattern for the antenna. In this way, antenna 40 may provide relatively uniform coverage over an entire hemisphere at frequencies between 10 GHz and 300 GHz and with adjustable polarization diversity.

The foregoing is merely illustrative and various modifications can be made by those skilled in the art without departing from the scope and spirit of the described embodiments. The foregoing embodiments may be implemented individually or in any combination.

What is claimed is:

1. An antenna, comprising: a ground plane; a conductive patch having first and second arms extending from opposing sides of a given point along a first longitudinal axis and having third and fourth arms extending from opposing sides of the given point along a second longitudinal axis, wherein the second longitudinal axis is oriented at a non-parallel angle with respect to the first longitudinal axis; a first conductive pad interposed between the ground plane and the conductive patch; a second conductive pad interposed between the ground plane and the conductive patch; an antenna feed having a first feed terminal coupled to the first conductive pad and a second feed terminal coupled to the ground plane; a first conductive structure that couples the first conductive pad to the first arm of the conductive patch;

and a second conductive structure that couples the second conductive pad to the second arm of the conductive patch.

2. The antenna defined in claim 1, further comprising: a third conductive pad interposed between the ground plane and the conductive patch; an additional antenna feed having a third feed terminal coupled to the third conductive pad and a fourth feed terminal coupled to the ground plane; and a third conductive structure that couples the third conductive pad to the third arm of the conductive patch.

3. The antenna defined in claim 2, further comprising: a fourth conductive pad interposed between the ground plane and the conductive patch; and a fourth conductive structure that couples the fourth conductive pad to the fourth arm of the conductive patch.

4. The antenna defined in claim 3, further comprising: a dielectric substrate, wherein the first, second, third, and fourth conductive structures comprise conductive vias extending through the dielectric substrate.

5. The antenna defined in claim 3, wherein the first, second, third, and fourth conductive pads are located in a common plane.

6. The antenna defined in claim 5, wherein the antenna is configured to transmit and receive wireless signals at a frequency between 10 GHz and 300 GHz.

7. The antenna defined in claim 6, wherein the first feed terminal is separated from the first conductive structure by a first distance, the conductive patch is separated from both the first conductive pad and the second conductive pad by a second distance, the first and second arms of the conductive patch both have a selected length, the second conductive structure is separated from an end of the second conductive pad by a third distance, and a sum of the first distance, the second distance, the third distance, and twice the selected length is approximately equal to one-half of a wavelength of operation of the antenna.

8. The antenna defined in claim 2, wherein the first, second, third, and fourth arms of the conductive patch each have the same length.

9. The antenna defined in claim 2, further comprising:

first and second openings in the ground plane;

a first transmission line coupled to the first feed terminal through the first opening in the ground plane; and a second transmission line coupled to the third feed terminal through the second opening in the ground plane.

10. The antenna defined in claim 1, wherein the first longitudinal axis is oriented at 90 degrees with respect to the second longitudinal axis.

11. An electronic device, comprising: a stacked dielectric substrate having a first layer, a second layer, and a third layer, the second layer being interposed between the first and third layers; first metal traces on the first layer, wherein the first metal traces form an antenna ground plane for an antenna that handles antenna signals at a frequency that is greater than 10 GHz; second metal traces on the second layer that form a conductive landing pad; third metal traces on the third layer that form a cross-shaped patch; and a plurality of conductive vias coupled between a given arm of the cross-shaped patch and the conductive landing pad, wherein the conductive landing pad, the cross-shaped patch, and the plurality of conductive vias form at least part of an antenna resonating element for the antenna.

12. The electronic device defined in claim 11, further comprising: a first antenna feed having a first feed terminal coupled to the conductive landing pad and a second feed terminal coupled to the first metal traces, wherein the second metal traces form an additional conductive landing pad; a second antenna feed having a third feed terminal coupled to the additional conductive landing pad and a fourth feed terminal coupled to the first metal traces.

13. The electronic device defined in claim 12, further comprising:

switching circuitry coupled to the first and second antenna feeds; and control circuitry, wherein the control circuitry is configured to adjust the switching circuitry between a first state at which the first antenna feed is active and the second antenna feed is inactive and a second state at which both the first and second antenna feeds are active.

14. The electronic device defined in claim 13, wherein the given arm of the cross shaped patch extends along a first longitudinal axis, the cross shaped patch has an additional arm extending along a second longitudinal axis perpendicular to the first longitudinal axis, and the electronic device further comprises an additional conductive via that couples the additional conductive landing pad to the additional arm of the cross shaped patch.

15. Apparatus, comprising:

an antenna ground;

an antenna resonating element over the antenna ground, wherein the antenna resonating element has first and second arms extending along a first longitudinal axis, third and fourth arms extending along a second longitudinal axis that is oriented at a non-parallel angle with respect to the first longitudinal axis, and first, second, third, and fourth legs extending respectively from the first, second, third, and fourth arms towards the antenna ground, wherein the first and second arms are coplanar with the third and fourth arms; and an antenna feed having a first feed terminal coupled to the antenna resonating element and a second feed terminal coupled to the antenna ground.

16. The apparatus defined in claim 15, wherein the antenna resonating element comprises first, second, third, and fourth conductive contact pads, the first leg extends from the first arm to the first conductive contact pad, the second leg extends from the second arm to the second conductive contact pad, the third leg extends from the third arm to the third conductive contact pad, and the fourth leg extends from the fourth arm to the fourth conductive contact pad.

17. The apparatus defined in claim 16, further comprising:

an additional antenna feed having a third feed terminal coupled to the third conductive contact pad and a fourth feed terminal coupled to the antenna ground, wherein the first feed terminal is coupled to the first conductive contact pad.

18. The apparatus defined in claim 17, further comprising:

millimeter wave transceiver circuitry configured to transmit millimeter wave signals over the antenna feed and the additional antenna feed.

19. The apparatus defined in claim 18, further comprising:

a dielectric substrate, wherein the antenna resonating element, the antenna ground, and the millimeter wave transceiver circuitry are formed on the dielectric substrate.

* * * * *